United States Patent [19]

Pogonowski

[11] 3,995,438

[45] Dec. 7, 1976

[54] METHOD FOR INCREASING THE LOAD CARRYING CAPACITY AND PULL-OUT RESISTANCE OF HOLLOW PILES

[75] Inventor: Ivo C. Pogonowski, Houston, Tex.

[73] Assignee: Texaco Inc., New York, N.Y.

[22] Filed: Nov. 4, 1974

[21] Appl. No.: 520,709

Related U.S. Application Data

[62] Division of Ser. No. 401,778, Sept. 28, 1973, Pat. No. 3,874,181, which is a division of Ser. No. 247,584, April 26, 1972, Pat. No. 3,795,035.

[52] U.S. Cl. ..... 61/53.68; 61/98; 61/53

[51] Int. Cl.[2] ..... E02D 5/44

[58] Field of Search ..... 61/53.68, 56, 56.5, 61/53, 54, 46; 52/726, 298, 288

[56] References Cited

UNITED STATES PATENTS

| | | | |
|---|---|---|---|
| 2,036,793 | 4/1936 | Christie | 61/56 |
| 2,168,459 | 8/1939 | Upson | 61/53 |
| 2,933,898 | 4/1960 | Upson | 61/46 |
| 3,375,670 | 4/1968 | Serota | 61/53.68 |
| 3,382,680 | 5/1968 | Takano | 61/56 |

FOREIGN PATENTS OR APPLICATIONS

| | | | |
|---|---|---|---|
| 599,786 | 7/1934 | Germany | 61/53.68 |
| 1,034,128 | 6/1966 | United Kingdom | 61/53.68 |

*Primary Examiner*—Jacob Shapiro
*Attorney, Agent, or Firm*—T. H. Whaley; C. G. Ries; Theron H. Nichols

[57] ABSTRACT

A plurality (preferably six) pistons and cylinders are suspended from the swage block a precise distance below the upper edge and actuatable radially from the longitudinal axis of a tubular member for making a new pile with anchor knobs for increased load carrying capacity and pull-out resistance.

1 Claim, 13 Drawing Figures

10
11
4
4
23
24b
25a
25b
2
2
24a
18
24c
17
16
25c 14
11
10
3
3
15a
13a
13d
15

METHOD FOR INCREASING THE LOAD CARRYING CAPACITY AND PULL-OUT RESISTANCE OF HOLLOW PILES

This is a division of application Ser. No. 401,778, filed Sept. 28, 1973, now U.S. Pat. No. 3,874,181, issued Apr. 1, 1975, which was a division of Ser. No. 247,584, filed Apr. 26, 1972, now U.S. Pat. No. 3,795,035, issued Mar. 5, 1974.

BACKGROUND OF THE INVENTION

In the swage joining of two oil well casings by hydraulic expanding devices, a permanent deformation often results in two overlapping casings, depending on the type of joint formed. Where six hydraulic swaging rams are utilized in joining a smaller upper end of one casing to a larger bottom end of an upper casing, as by dimpling as illustrated in my U.S. Pat. No. 3,555,831, the free upper edge of the smaller inner casing end often distorts into a hexagonal shape with six straight sides spaced from the wall of the larger upper casing. These straight sides accordingly leave less working space in the casings for drill bits, drill stems, etc., for example.

OBJECTS OF THE INVENTION

Accordingly, it is a primary object of this invention to provide at least one method for eliminating protuberances internally of tubular joints for producing more operating space therein.

Another primary object of this invention is to provide at least two embodiments for carrying out or practicing the disclosed method.

Another object of this invention is to provide a device for swaging or deforming one tubular member inside of another which is easy to operate, is of simple configuration, is economical to build and assemble, and is of greater efficiency for providing more working space internally of the tubular members.

Another object of this invention is to provide a method for joining two horizontal telescopic pipe ends together.

A further object of this invention is to provide a swaging mechanism for carrying out the method of joining two horizontal pipes together.

A still further object of this invention is to provide an insert for water immersed pipes for preventing cracking thereof.

Another object of this invention is to provide a method and mechanism for increasing the load capacity and pull-out resistance of piling driven in the ground.

Other objects and various advantages of the disclosed method and devices for swaging one tubular member inside another tubular member will be apparent from the following detailed description, together with accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, two forms or mechanisms for carrying out the method of the invention wherein like reference numerals have been employed to indicate similar parts in the several views in which.

DESCRIPTION OF THE INVENTION

The invention disclosed herein, the scope of which being defined in the appended claims, is not limited in its application to the details of construction and arrangement of parts shown and described for carrying out the disclosed method, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises a few methods for eliminating the shelf formed on the inner surface of a well casing larger end by a non-round upper end portion of a well casing smaller end secured therein comprising the steps of, 1. swaging the non-round portions of the upper edge of the inner well casing outwardly firmly against the larger well casing inner surface, and 2. simultaneously swaging the non-round portions spaced below the upper edge of the smaller well casing firmly against the larger well casing inner surface.

A second method comprises, 1. positioning a plurality of pistons and cylinders in a horizontal plane and a precise distance below the upper edge of the smaller well casing, and 2. deforming the upper edge of the well casing smaller end firmly against the well casing larger end surface by simultaneous actuation of at least two pistons and cylinders 180° directly opposite from each other for providing more operating room internally of the well casings.

Another method for deforming a smaller end of a first pipe internally of a larger end of a second pipe comprises, 1. positioning a plurality of pistons and cylinders in several planes, each plane being normal to the longitudinal axis of the first pipe at a precise distance from the first pipe smaller end, and 2. deforming the first pipe smaller end against the second pipe larger end by actuation of all pistons and cylinders outwardly in a radical direction opposite from each other for providing more operating room internally of the pipes.

DESCRIPTION OF THE DEFORMING DEVICES

Two embodiments are disclosed in FIGS. 1–4 and FIG. 5, respectively, for practicing or carrying out the above methods of the invention.

Figure 1:
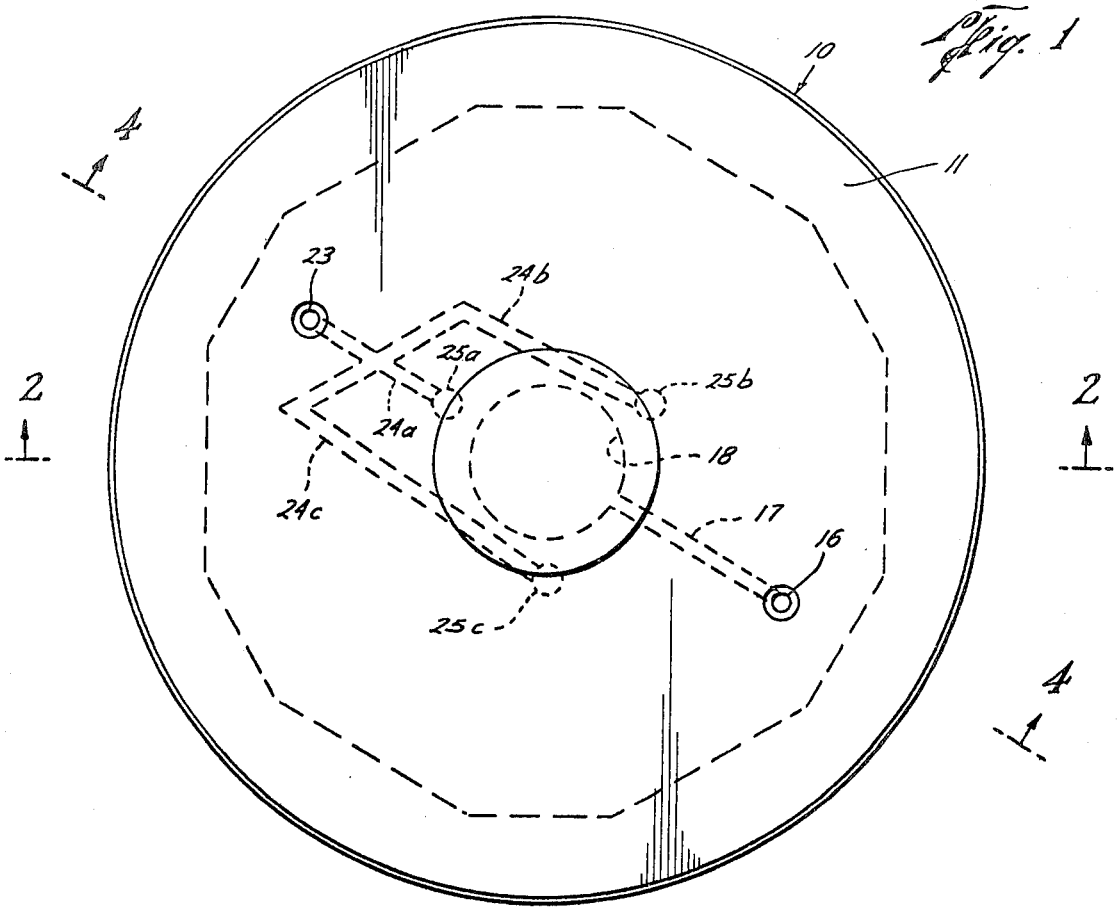
FIG. 1 is a schematic plan view of one embodiment of the new tubular swaging device.

FIG. 1, a plan view of a swage 10, illustrates hydraulic oil lines for supplying pressure fluid to swaging actuators disclosed hereinafter.

Figure 2:
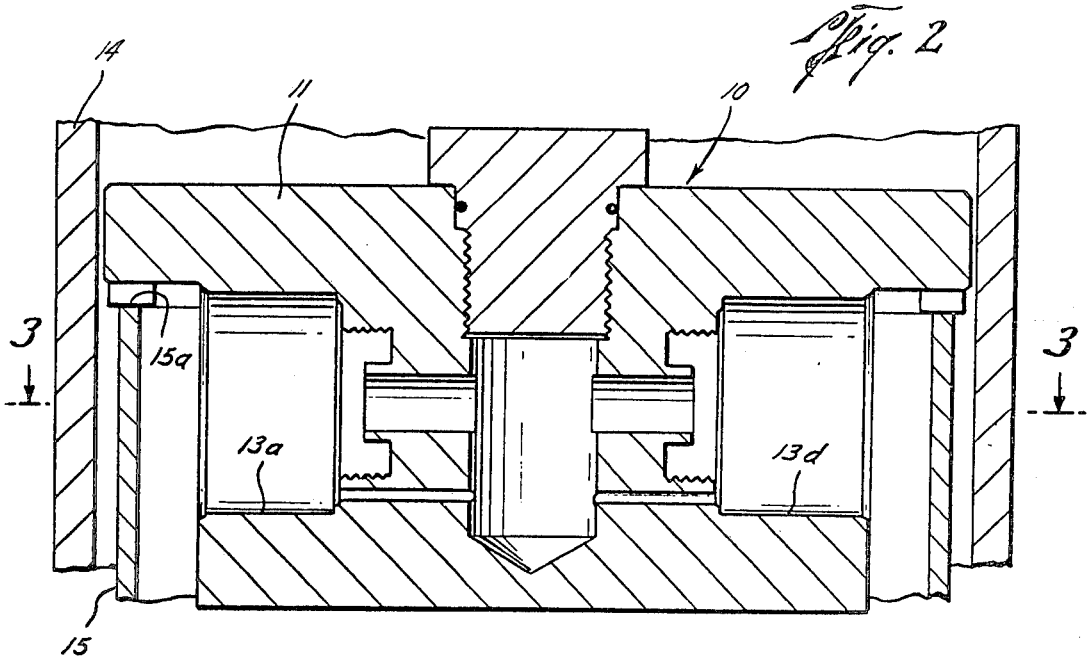
FIG. 2 is a section at 2—2 on FIG. 1.

FIG. 2, a schematic sectional view taken at 2—2 on FIG. 1 of one of the swaging devices 10 for carrying out at least one of the methods of the invention comprises a cylindrical swage block 11 supporting a deforming means 12, such as a plurality of pistons and cylinders, pistons 12*a*, 12*d* and their respective cylinders 13*a*, 13*d* being illustrated in this figure.

As illustrated in FIG. 2, the cylindrical swage block 11 is small enough to loosely fit internally of the enlarged lower end of a tube, as a well casing 14, and large enough to rest on the upper deformed edge 15*a* of the upper end of a second well casing 15. While the latter casing is secured to the upper well casing 14 a little below the illustrated section of FIG. 2, the upper deformed edge 15*a* has straight portions which extend inwardly from the inner wall or are spaced from the inner wall of the casing 14 to accordingly form a shelf on which all items being lowered in the well tend to hang up on.

Figure 3:
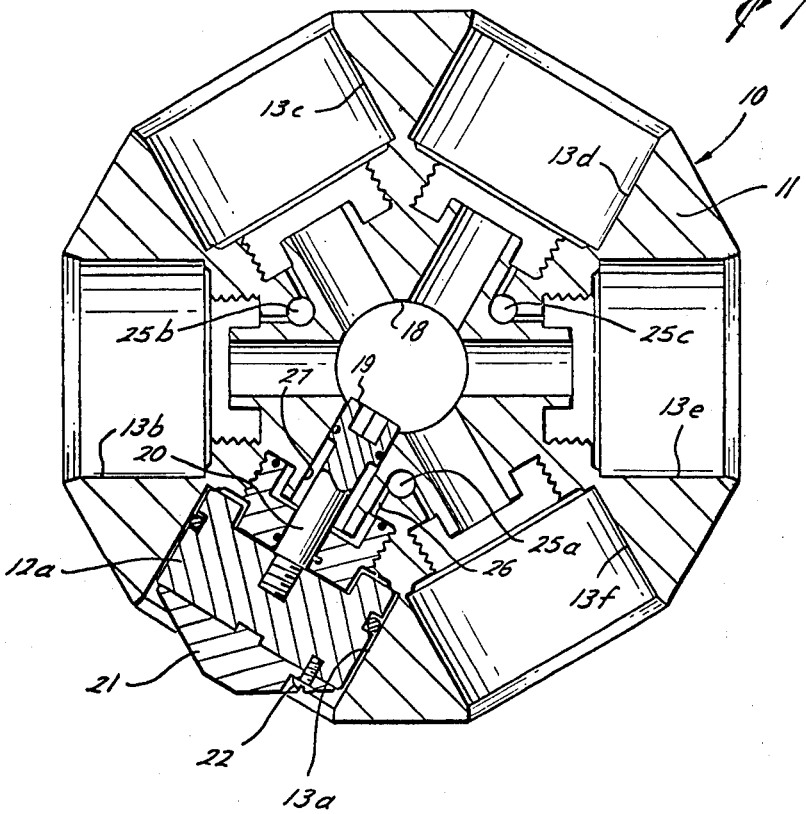
FIG. 3 is a section at 3—3 on FIG. 2.

FIG. 3, a sectional view of 3—3 on FIG. 2, with parts in section illustrates a swage comprising six pistons and cylinders for swedging or deforming into the cylindrical casing wall 14, FIG. 2, any section of the cylindrical casing wall 15 spaced from the wall of casing 14, as straight sections particularly. In FIG. 3, cylinders 13*b* to 13*f* are illustrated with their pistons 12*b* to 12*f* removed for clarity of disclosure, as well as cylinders 13*a* and 13*d* on FIG. 2. These straight sections occur when an inner casing or tube is attached to an outer casing or tube by riveting or swaging as by the forming of dimples through the walls of both tubes, as shown in my abovementioned U.S. Pat. No. 3,555,831. When an inner tube or casing is thus secured, the result is sometimes inward flaring or warping of the upper free edge of the inner casing. Thus when equally spaced dimples are utilized, the upper edge 15*a* of casing 15 forms a rough hexagon in plan view and accordingly six pistons and cylinders are required to reshape the hexagon back into its original cylindrical shape. If eight dimples are utilized as illustrated in inventor's above identified patent, to secure an inner casing upper end to an outer casing lower end, then an octagon shaped free upper edge is formed immediately above the dimples on the inner casing upper end.

Figure 4:
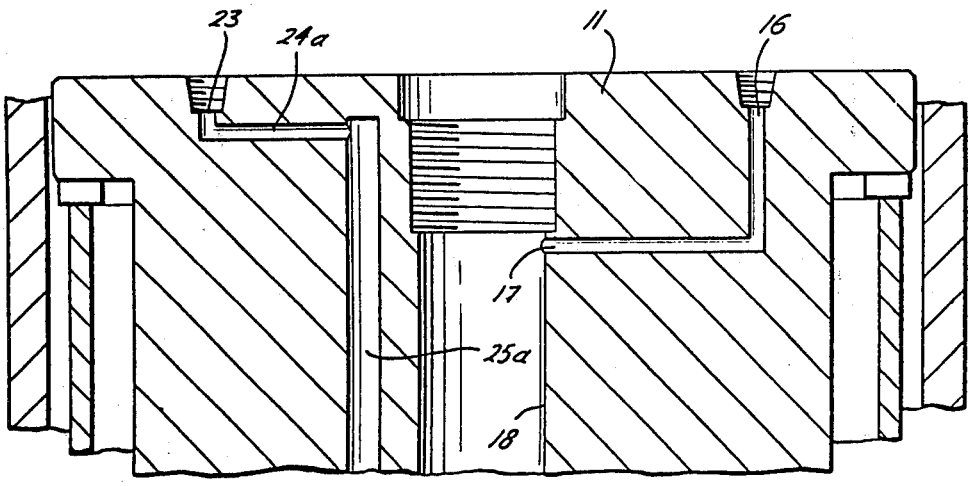
FIG. 4 is a schematic section at 4—4 on FIG. 1.

FIG. 4, a sectional view at 4—4 on FIG. 1, illustrates more details of the supply and return hydraulic ducts for the pistons and cylinders shown in FIG. 3. Piston and cylinder, 12*a*, 13*a*, respectively, are typical. Actuating fluid under high pressure from a high pressure source (not shown) on top of the cylinder block 11, FIGS. 1 and 4, is supplied through passages 16 and 17 to a central reservoir 18. The high pressure fluid from central reservoir 18 passes to cylinder 13*a*, FIG. 3, for example, and behind piston 12*a* through ducts (not shown) and also directly to the inner end 19 of piston rod 20 for actuating piston 12*a* radially outwardly.

Piston 12*a*, FIG. 3, has a case-hardened deforming or coldworking tip 21 secured thereto with screws 22 for swaging or deforming inner casing 15, FIG. 2, against casing 14. End 19, FIG. 3, of the piston rod 20 is enlarged to form a return stroke piston. The return stroke of piston 12*a* is accomplished by depressurizing conduits 16 and 17, FIG. 4, and pressurizing conduits 23, 24*a*, and 25*a* leading to conduit 26, FIG. 3, and to small cylinder 17 to actuate return stroke piston 19 radially inwardly to the position illustrated. Three vertical ducts 25*a*, 25*b*, and 25*c* are utilized, each duct supplying piston-return-movement-pressure fluid for a pair of pistons. With inward return movement of piston 19, reverse flow occurs in reservoir 18, FIG. 4, and conduits 17 and 16. Pistons 12*b*–12*f*, FIG. 3, are actuated similarly and simultaneously with piston 12*a* in their respective cylinders to deform the casing edge 15*a*, FIG. 2, against outer casing 14.

MODIFICATION I

Figure 5:
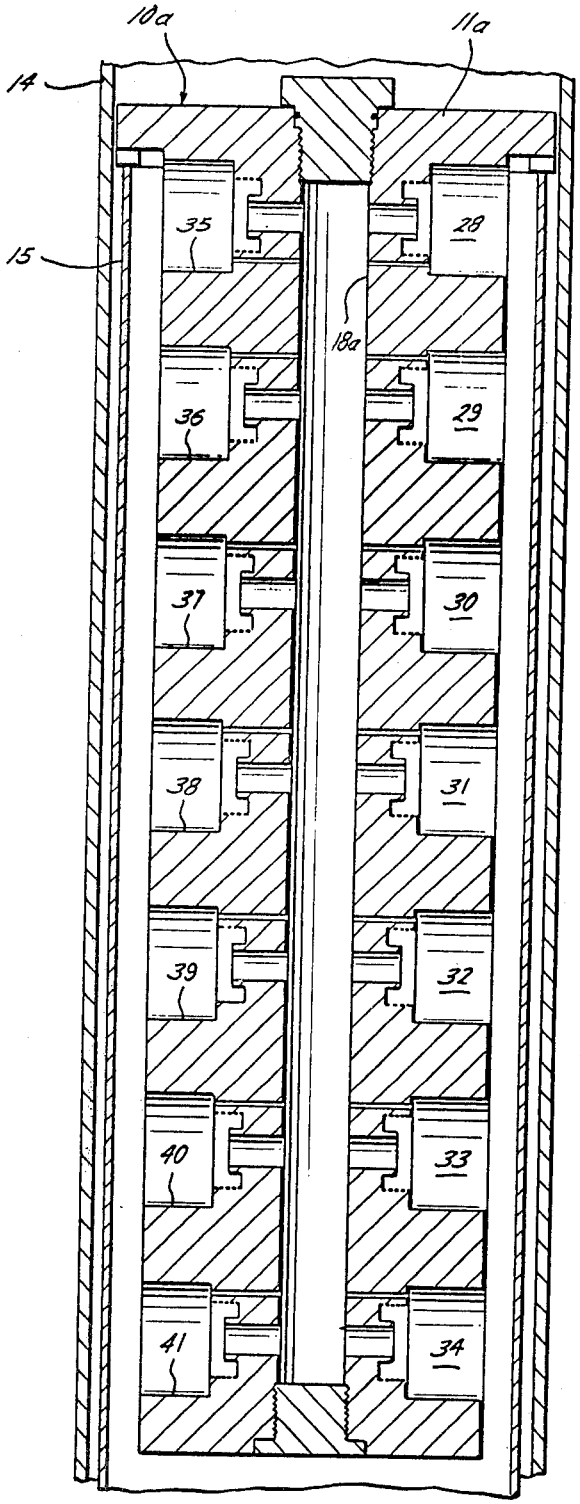
FIG. 5 is a vertical sectional view of another modification of the embodiment of FIG. 1.

FIG. 5 illustrates schematically, in a vertical section, another embodiment for practicing the aforementioned method of the invention. This swage 10*a* comprises a swage block 11*a* supporting seven rows of pistons 28–34, each row being similar to the row of the first modification of FIG. 3, with six equally spaced pistons in each row operable in their respective seven rows of cylinders 28–41. Similarly, reservoir 18*a* supplies high pressure fluid to the pistons for actuating all pistons for deforming inner casing 15 against outer casing 14. Likewise, this swage includes return stroke pistons and their accompanying pressure conduits similar to those of the first embodiment for retracting the pistons within the swage after the swaging or deforming operation.

The swage of each of the above disclosed embodiments have either a self-contained unit mounted thereon including a pump and reservoir of hydraulic fluid with control cables running up the swage support wire, or they have long pressure hoses extending up the swage support wire to the pumps and reservoirs.

MODIFICATION II

A method is disclosed for sealing together two telescopic pipe ends comprising the steps of, 1. positioning a sheet of elastic material or cementing the material which requires an undisturbed curing period, i.e. 2 hours, between the two telescopic pipe ends, 2. deforming a circular first row of dimples through both pipes in a plane normal to the pipe longitudinal axis, and 3. deforming a plurality of rows of dimples simultaneously and parallel to the first row of dimples for forming an efficient, quick, and high strength pipe joint.

Figure 6:
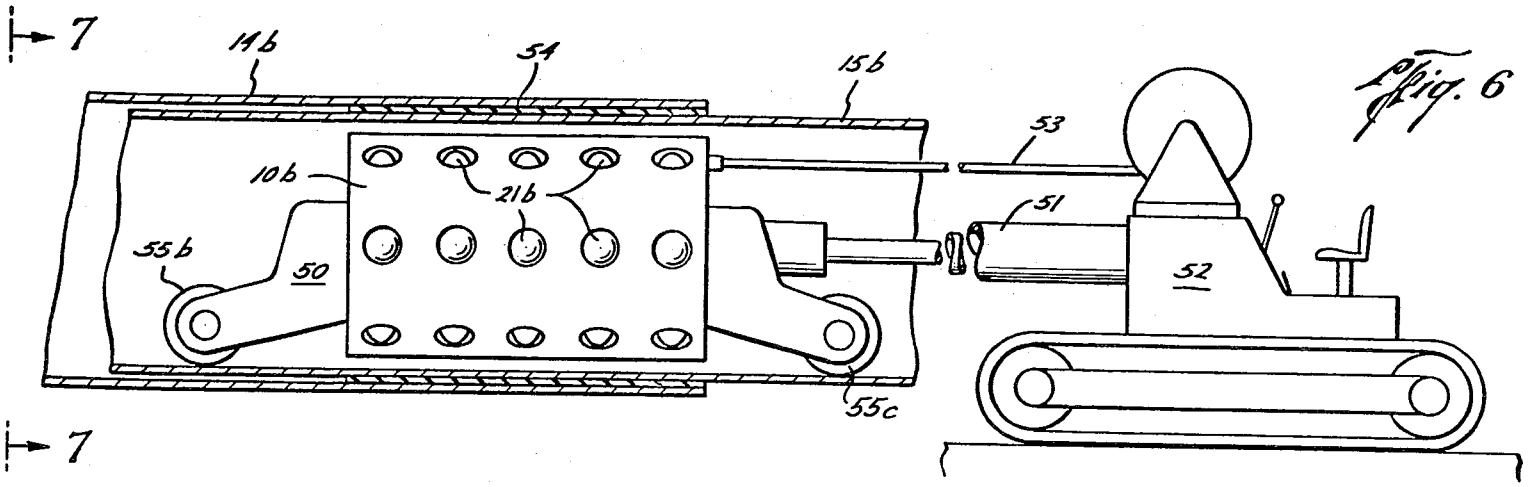
FIG. 6 is a schematic sectional view of another modified swaging device for joining two tubes together illustrating the deforming tips in retracted position.
Figure 8:
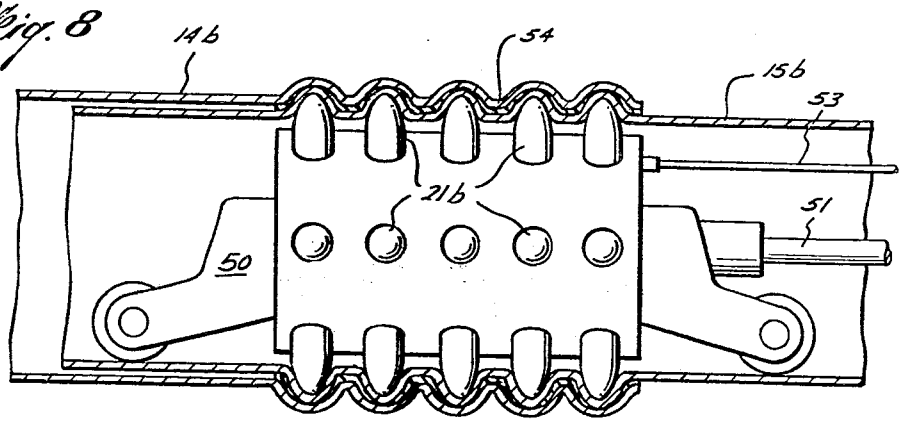
FIG. 8 is a section of the truck and swage of FIG. 6 with the deforming tips illustrated in extended position for swaging the two tubes together.
Figure 7:
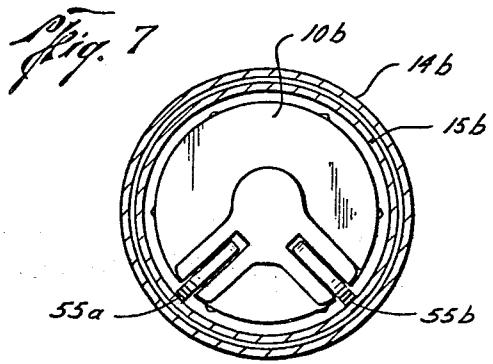
FIG. 7 is a section at 7—7 on FIG. 6.

FIGS. 6, 7, and 8 disclose a swage cold working pipe connector for practicing one of the methods described above for permanently connecting or sealing two telescopic horizontal pipes together, as for cargo pipe lines, particularly, in addition to air cargo lines (air in the pipe being the vehicle), oil lines, gas lines, and water lines.

FIG. 6 is a schematic view, with parts in section, of a swaging mechanism 10*b* for joining together two horizontal external and internal pipe ends, 14*b* and 15*b*, respectively. Here, the truck 50 supporting the swage 10*b* centrally of the pipes is rolled internally of the pipes by expanding of telescopic arm 51 from a hydraulic actuator as tractor 52 having hydraulic fluid hose 53.

FIG. 7, a sectional view at 7—7 on FIG. 6, illustrates centering wheels 55*a*, 55*b*, and 55*c* for supporting truck 50 for longitudinal movement internally of the pipes.

FIG. 8, a sectional view at 8—8 on FIG. 7, illustrates the case-hardened tips 21*b* of the pistons (not shown) of the swage 10*b* being extended for deforming and dimpling the pipe ends 14*a* and 15*b*. The actuating mechanism comprising the pistons for operating in cylinders of this modified swage 10*b* are very similar to those illustrated in FIG. 3 of swage 10. All dimples or deformations are swaged beyond the yield point to prevent springback.

Figure 8A:
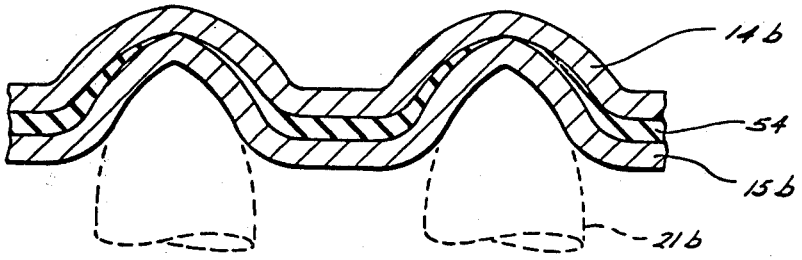
FIG. 8*a* is a detailed sectional view of the depressions of FIG. 8.

FIG. 8A illustrates the flow of the elastic material between the two telescopic pipes in the area of the dimples through the walls of the two pipes.

FIG. 6 illustrates the sealing swage 10*b* for sealing the two horizontal (or vertical like well casing) pipes together comprising a swage block 11*b* having five parallel rows of six pistons and cylinders each for forming five rows of dimples or depressions in the two joining ends of the horizontal cargo pipes. While the outer and inner pipes, 14*b* and 15*b*, respectively, are shown as alternating slightly smaller and larger diameter pipes, they may all be formed alike with one enlarged end each to slide over the smaller end, if so required and desired for providing constant inside diameter for laminar flow. An annular lining 54 of rubber-like material, such as but not limited to silicon rubber having a working temperature resistance range of −130° to +500° F. circumscribes the inner end 15*b* prior to swaging or cold working in the dimples.

This swage 10*b* is used to form rows of continuous dimples almost touching each other. To accomplish this extraordinary seal, the swage is actuated by first moving outwardly all pistons from their respective hydraulic cylinders to form with their case-hardened tips parallel rows of six evenly spaced deep dimples 60° apart around the internal peripheral pipe surface. The pistons are retracted, the telescopic rod 51 and when using a sleeve gasket or lining 54, the swedge 10*b* are rotated 12 degrees about the longitudinal axis of the rod, and the pistons are actuated outwardly again to form a second set of dimples adjacent to the first. This process is repeated by the swage four times after the initial actuation to provide another set of six dimples spaced radially by 12°. This radial spacing may be decreased to 6° with nine additional actuations by the swage, the greater the pipe diameter, the greater the number of swage operations is preferred.

Quick field connections may be made on an oil or gas line with the above swage deformations for providing a very good fluid-tight seal or joint without time taking, slow, expensive welding.

Use of the insulating fluid-tight gasket 54 provides a pipe line cathodic corrosive protection system. This cold working process generates less tendency and susceptibility of the pile to galvantic corrosion than does the welding process, as the latter process results in uninterrupted electrical conductivity throughout the length of the pipe line, thereby enhancing the corrosion damage and increasing the cost of preventative measures. Accordingly a more economical and faster pipe connection results, particularly in areas inaccessible to welding.

Particularly, this cold-working pipe connection provides quick field assembly in a hostile environment. Further, a constant internal diameter pipeline may be constructed without field welding using prefabrication, prepositioned seal, and cold working by the hydraulic swage.

MODIFICATION III

Figure 9:
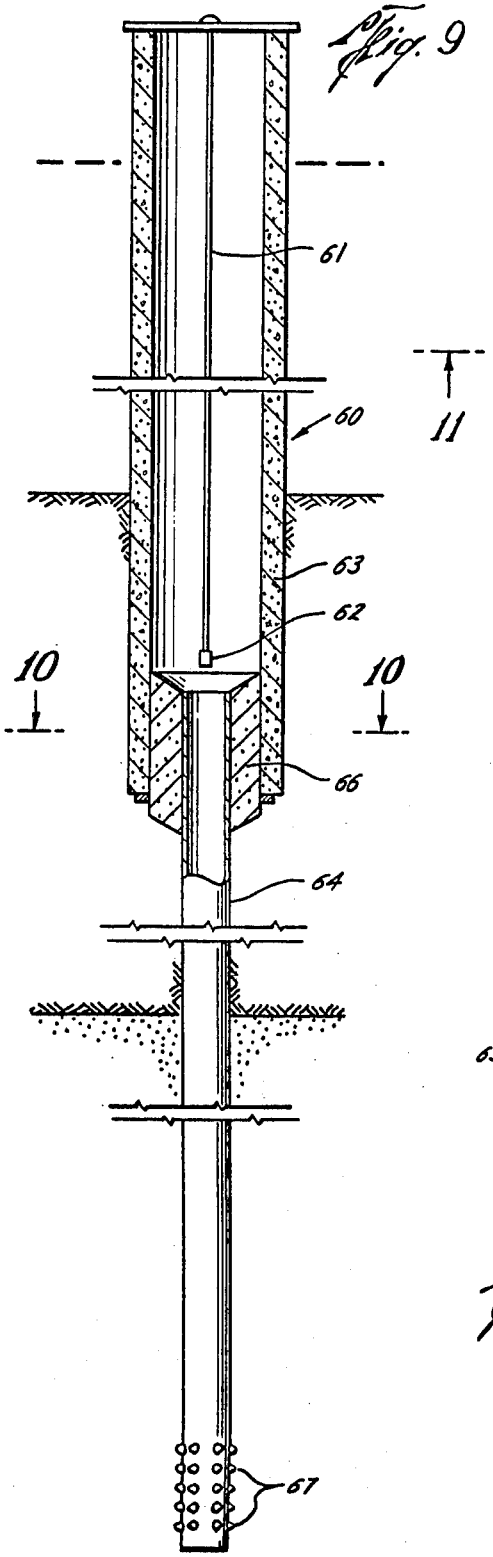
FIG. 9 is a schematic sectional view of a composite steel-concrete pile immersed in freezing water with an insert therein.

FIG. 9, a schematic sectional view of a water immersed composite concrete and steel pile 60 with the new insert 61 protruding therein deeper than the freezing depth of the water around and inside the pile for preventing cracking due to the water freezing internally of the pile. Insert 61 is a long flexible, soft, and resilient element. It is formed of a soft plastic material as silicon foam rubber, for example. While the cylindrical shape filled with air is preferred, it may also comprise instead, a multiplicity of interconnected spheres, if so desired and required.

Insert 61 is weighted at the bottom with a suitable inert weight 62, such as but not limited to the resistant mineral barite, it also may be concrete. Thus the insert would be squeezed and contracted as the water freezes internally of the pile and cracking thereof is obviated for the full length of formation of the resultant ice block in the pile.

MODIFICATION IV

A new method for increasing the load carrying capacity and pull-out resistance of a hollow pile comprises the steps of, 1. driving a pile having a malleable steel lower end portion into the ground to the desired and required depth, and 2. forming protrusions or anchor bumps outwardly on the pile external surface.

A method step intermediate the above steps (1) and (2) may include:

1a). evacuating any earth inside the pile.

Also, in greater detail, the second step may comprise swaging recesses outwardly from internally of the pile to form the anchor bumps on the pile external surface.

Figure 10:
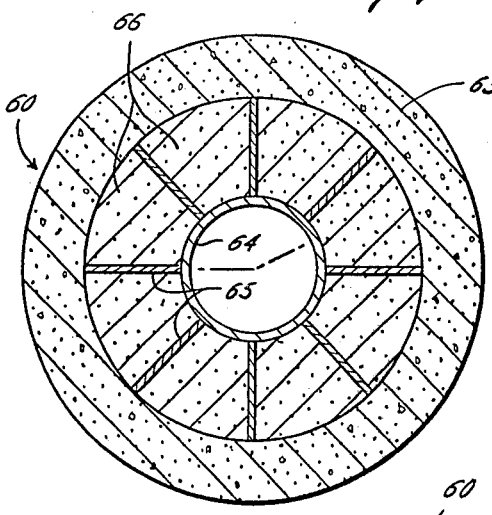
FIG. 10 is a section at 10—10 on FIG. 9.
Figure 11:
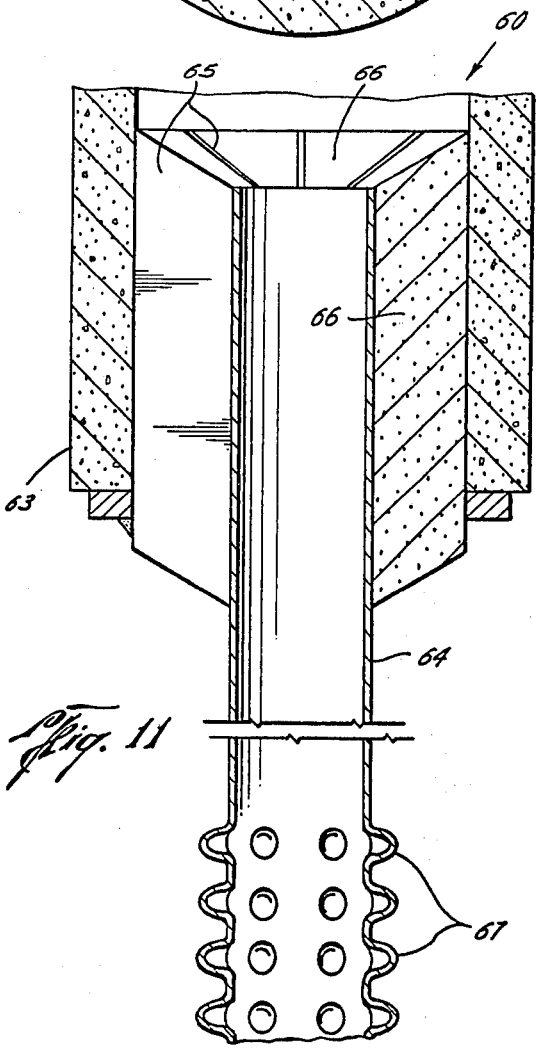
FIG. 11 is a section at 11—11 on FIG. 10.

FIGS. 10 and 11 disclose at least one new pile for carrying out or practicing the above method. This pile 60, which has greatly increased load capacity and pull-out resistance, is disclosed in FIG. 10, a section at 10—10 on FIG. 9 and in FIG. 11, a section at 11—11 on FIG. 10.

This composite pile 60 comprises a 54 inch outside diameter concrete pipe portion 63 joined to a 3 foot outside diameter metal pipe portion 64, the latter pipe portion having metal gussets 65 joined to the former pipe portion with grout 66.

The lower end of the metal pipe portion 64 has deformations or anchor bumps 67 formed therein in spaced apart horizontal rows coaxial with each other and coaxial with the pipe portion 64, the bumps being formed by a swage like 10*b*, FIGS. 6–8, to protrude outwardly a distance of at least the thickness of the pile wall after the pile is driven in the marsh, tundra, lake, or ocean bottom, for example.

Figure 12:
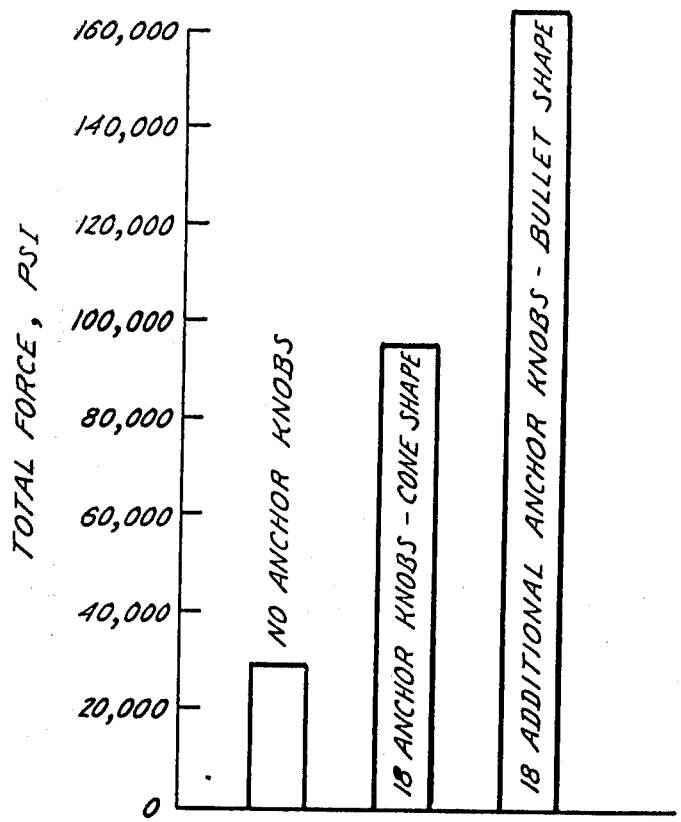
FIG. 12 is a graph illustrating the increased load carrying capacity and pull-out resistance added to the pile by the anchor knobs.

These anchor bumps 67 greatly increase the load carrying capacity and pull-out resistance of the pile 60 as evidenced by the graph of FIG. 12 from inventor's report "Test of Skin Friction With and Without Swaging-Comparison of Smooth Pipe vs. Anchor Pattern by Hydraulic Swage". Here the test specimen had a 7 inch ID, 7⅜ inch OD, and 9 inch length imbedded to a depth of 7 inches in a container of lead having an 11 inch ID, 11½ inch OD, and a 10 inch height.

Accordingly, from FIG. 12, with a total force required to pull out the smooth test pile being less than 30,000 pounds and a total force required to pull out the test pile with 36 indentations being greater than 160,000 pounds, the increase in pull-out resistance was over 5 times greater with the disclosed anchor bumps.

Thus an efficient, high strength, elongated pile is disclosed having increased load carrying capacity and pull-out resistance which is especially critical in sandy soils.

Accordingly, it will be seen that the disclosed methods and swages for practicing the methods for producing more working space internally of two interconnected tubes for connecting two telescopic pipes together, and for increasing the load carrying capability and pull-out resistance of piles operate in a manner which meets each of the objects set forth hereinbefore by the use of various combinations of the disclosed multiple piston and cylinder swage.

While a few methods of the invention and two swages for carrying out the methods have been disclosed, it will be evident that various other methods and modifications are possible in the arrangement and construction of the disclosed methods and swages without departing from the scope of the invention and it is accordingly desired to comprehend within the purview of this invention such modifications as may be considered to fall within the scope of the appended claims.

I claim:

1. A method for increasing the load carrying capacity and pull-out resistance of a hollow pile comprising the steps of, a. driving a metal concrete pile formed with an upper hollow concrete portion securely connected to a malleable lower portion into the ground to the desired depth, b. lowering a multiple piston swag inside the pile into the lower malleable portion, c. swaging a plurality of anchor bumps simultaneously in the pile to form a plurality of horizontal rows of anchor bumps on the pile peripheral external surface, and d. swaging the plurality of anchor bumps of the plurality of horizontal rows likewise simultaneously into vertical rows of anchor bumps for forming a new high load carrying, pull-out resistant, composite metal concrete pile.

* * * * *